US005245722A

United States Patent [19]

Dameron

[11] Patent Number: 5,245,722

[45] Date of Patent: Sep. 21, 1993

[54] METHOD OF WASHING ARTICLES USING A ROTATING DRUM WASHING MACHINE

[76] Inventor: Sylvie Dameron, 11, rue des deux fréres Laporte, 78680 Epone, France

[21] Appl. No.: 749,085

[22] Filed: Aug. 23, 1991

[30] Foreign Application Priority Data

Aug. 23, 1990 [FR] France ..... 90 10582

[51] Int. Cl.[5] ..... D06F 21/02

[52] U.S. Cl. ..... 8/158; 8/159; 68/29

[58] Field of Search ..... 8/158, 159; 68/13 R, 68/29, 30; 51/164.5; 241/184

[56] References Cited

U.S. PATENT DOCUMENTS

| | | | |
|---|---|---|---|
| 163,947 | 6/1875 | Robinson | 68/30 X |
| 1,331,964 | 2/1920 | Newhouse | 241/184 |
| 1,431,475 | 10/1922 | MacDonald | 51/164.5 X |
| 1,860,393 | 5/1932 | Newhouse | 241/184 |
| 4,881,385 | 11/1989 | Lambrechts | 68/29 |
| 5,093,948 | 3/1992 | Val et al. | 68/29 X |

FOREIGN PATENT DOCUMENTS

| | | | |
|---|---|---|---|
| 186628 | 6/1907 | Fed. Rep. of Germany | 68/30 |
| 1168286 | 7/1985 | U.S.S.R. | 241/184 |

*Primary Examiner*—Philip R. Coe
*Attorney, Agent, or Firm*—William A. Drucker

[57] ABSTRACT

The method for washing articles consists in introducing large elements into the machine drum with the articles to be treated, the elements having a flattened shape with rounded edges. Increasing the number of large elements and/or addition of an enzyme complex and/or a powder having similar properties and/or a material such a pumice results in premature (but controlled) wear of the articles to be treated. The invention considerably reduces the quantity of detergent products required for washing.

9 Claims, 1 Drawing Sheet

METHOD OF WASHING ARTICLES USING A ROTATING DRUM WASHING MACHINE

BACKGROUND OF THE INVENTION

The present invention concerns a method of and apparatus for washing articles such as woven or non-woven textiles, in particular clothes, in a rotating drum washing machine.

In conventional laundry washing machines, it is generally accepted that the washing effect is due to the combined action of the detergent introduced into the machine and mixing of the laundry with the detergent solution caused by rotation of the drum.

It has also to be noted that currently detergents used in washing powders constitute a significant source of water pollution and that considerable efforts have been made to attempt to develop an ecological, non-polluting washing powder.

It transpires that, up to the present, washing powder manufacturers have been replacing certain consituents of the washing powders by others which are also pollutants, knowing that this new pollution will only come to light in the future when the quantities used become sufficiently large. In the meantime, of course, the new washing powder is perceived as being ecological.

OBJECT OF THE INVENTION

The object of the invention is to provide a different solution to the problem.

It starts out from the fact that, prior to the use of modern washing techniques, poor detergent power of washing powders was compensated for by mechanical action on the washing, in particular beating the washing.

The invention thus proposes to introduce a mechanical action similar to beating into a washing machine in order to reduce the amount of detergent required in a washing powder.

To this end, the method of the invention consists in introducing large elements having a flattened shape and rounded edges into the drum along with the articles to be washed.

Preferably, these elements are constructed from a material having good wear resistance, for example an elastomer, a density of between 1 and 1.6 and a Shore hardness of between 50 and 80, preferably greater than 70.

It has indeed proved desirable in certain applications to bring about premature (but controlled) wear of the articles to be treated.

This is especially the case for "DENIM" cotton cloth or the like, used in the manufacture of jeans.

The most widely used current technique for premature wear is carried out using pumice which is introduced into the machine. This technique has a number of drawbacks, due primarily to the fact that the pumice disintegrates.

To overcome this drawback, the applicant has also developed a method consisting in introducing bodies made from a relatively hard elastomer (for example having a shape analogous to that of a golf ball) into the machine drum.

According to this method, the weight of the articles to be introduced into the drum is at least equal to the weight of the articles to be treated and is preferably between one and three times this weight.

This method, however, has the drawback of limiting the quantity of articles which can be treated due to the large weight and volume of the bodies used to induce wear.

A further object of the invention, then, is to overcome this problem.

It thus proposes to use, as in washing, large elements having flattened shape, these elements having two principal, substantially concave facing surfaces, and adding a predetermined quantity of abrasive liquid or powder or pumice to the drum interior.

The shape and dimensions employed of these elements are a function of the effect desired.

The advantage of this solution is to increase the quantity of articles to be treated in the one treatment cycle, shorten the cycle and to better control the wearing effect, particularly by regulating the quantity of abrasive liquid or powder and/or the granulometry of the pumice.

In all cases, the machine drum may advantageously be provided with vanes parallel to the rotation axis of the drum and extending radially inwards from the cylindrical internal surface.

BRIEF DESCRIPTION OF THE DRAWINGS

Non-limiting examples of embodiments of means for carrying out the method of the invention will now be described with reference to the accompanying drawings in which.

DESCRIPTION OF THE PREFERRED EMBODIMENT

Figure 1:
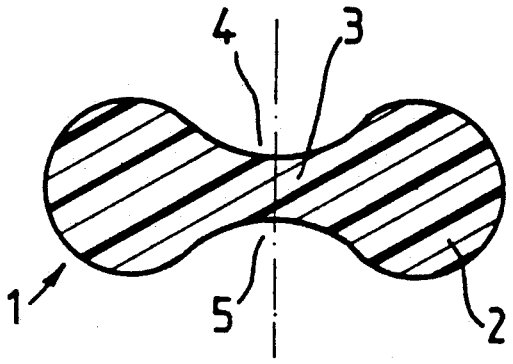
FIGS. 1 and 2 respectively represent an axial and a transverse section through a large element of lenticular shape.
Figure 2:
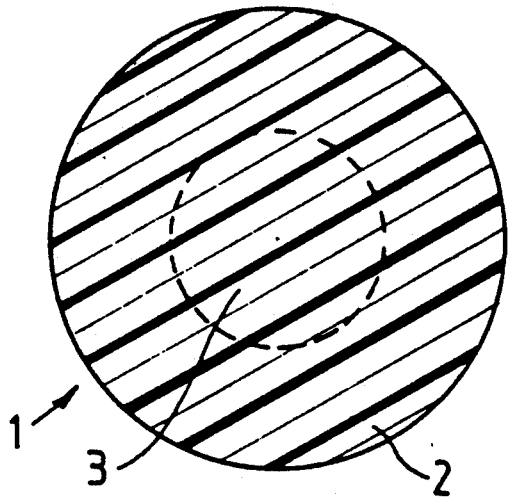
Figure 3:
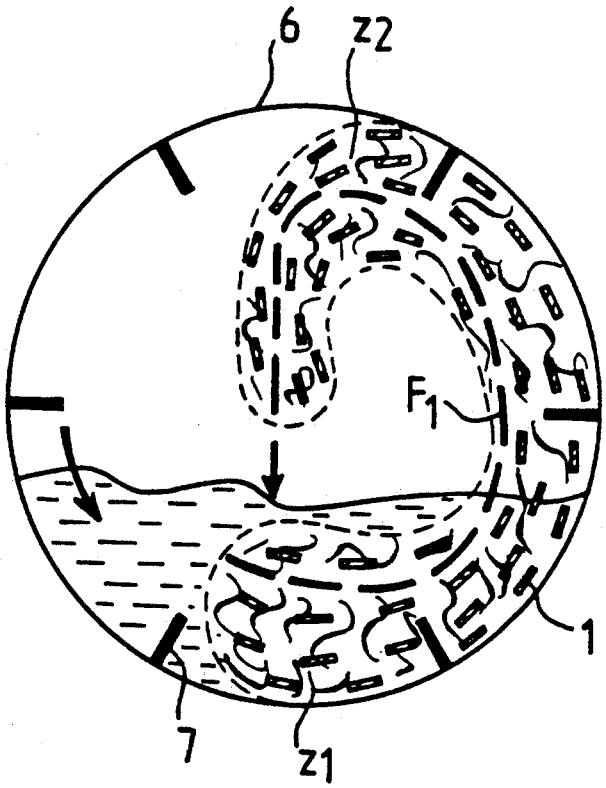
FIG. 3 schematically represents a machine drum provided with axial vanes in order to produce, along with the large elements, a beating effect.

As shown in FIGS. 1 and 2, large element 1 has a substantially lenticular shape with concave facing surfaces : its peripheral edge 2 is substantially toroidal, whilst the central region 3 forms two facing concavities 4, 5.

In this example, the diameter of element 1 is about 5 cm, with a weight of about 30 g. Element 1 is made of an elastomer of density between 1 and 1.6, with a Shore hardness of greater than 70.

To wash, a predetermined quantity of these elements is placed inside drum 6 of the machine, this quantity depending on the nature of the washing and how soiled it is.

Washing is carried out as normal by adding a detergent product to the washing water (but in far smaller quantities than usual).

Clearly; as the drum rotates, the washing cycle is as follows :

compression of the washing by the large elements in the base of the drum (zone $z_1$), lifting this mass (arrow $F_1$) by vanes 7 in drum 6 to the overbalance point (zone $z_2$), the mass falling to the base of drum 6 producing a beating effect on the fabric by large elements 1.

It is important to note that the presence of vanes 7 in drum 6 of the machine facilitates the upward movement of the large elements allowing them to strike the washing from a greater height, improving the beating effect thus produced.

If it desired to prematurely wear the fabric, a predetermined quantity of additional bodies are added to drum 6 with, if necessary, powder and/or liquid, or pumice (in addition to or replacing the detergent or bleach).

The treatment cycle is substantially the same as that described above. However, in this case, because of the greater quantity of large bodies used, the desired wear of the fabric is primarily due to abrasion of the fabric by said bodies.

This effect is improved by using an abrasive liquid or powder which tends to become lodged in the concavities in the large elements, forming reserves which are progressively released during abrasion.

One important advantage of the method described above lies in the fact that it softens the washing and avoids the need to use a softening agent.

This treatment for washing could also be used for other materials such as leather, silk, canvas, etc.

The invention is not limited to a particular type of abrasive agent to be used to obtain the desired effect of premature wear.

Thus the abrasive agent may in particular consist of a liquid containing at least one enzymatic complex prepared by fermentation of a strain of fungus, activating and regulating agents for the enzymatic complex and a wetting agent.

The action of this agent can be reinforced by increasing the quantity of large elements and/or introducing a powder having an abrasive effect and/or a material such as pumice into the drum.

What is claimed is:

1. A method of washing fabric articles using a washing machine with a rotating drum, said method comprising the steps of:

i. introducing into the drum massive elements each having a lenticular form with two concave opposing surfaces, said elements having a diameter of about 5 cm with a weight of about 30 g;

ii. introducing said fabric articles into said drum;

iii. pouring washing water into said drum;

iv. adding a detergent product to the washing water;

v. rotating the drum which encloses said massive elements, said fabric articles, said washing water and said detergent product, so as to obtain a washing cycle wherein the washing water as well as the detergent product tend to be lodged in said concave opposite surfaces, forming reserves which are progressively released during said washing cycle.

2. The method according to claim 1, wherein said product massive elements are made from an elastomer.

3. The method according to claim 1, wherein said massive elements are made from a material having a density of between 1 and 1.6.

4. The method according to claim 1, wherein said massive elements have shore hardness greater than 70.

5. The method according to claim 1, which further comprises a step of introducing into the drum abrasive elements which cooperates with said massive elements in said washing cycle so as to produce premature wear of said articles.

6. The method according to claim 5, wherein said abrasive elements are powder elements.

7. The method according to claim 5, wherein said abrasive elements are liquid elements.

8. The method according to claim 5, which further comprises a step of introducing into the drum at least one enzymatic complex prepared by fermentation of a fungus strain, activating and regulating agents for the enzymatic complexes and a wetting agent.

9. The method according to claim 5, wherein said abrasive elements comprise pumice.

* * * * *